US011674684B2

(12) United States Patent
Curry

(10) Patent No.: US 11,674,684 B2
(45) Date of Patent: Jun. 13, 2023

(54) CONTAINER LID WITH INTEGRAL CANDLE HOLDER

(71) Applicant: Alison Davis Curry, New York, NY (US)

(72) Inventor: Alison Davis Curry, New York, NY (US)

( * ) Notice: Subject to any disclaimer, the term of this patent is extended or adjusted under 35 U.S.C. 154(b) by 524 days.

(21) Appl. No.: 16/750,763

(22) Filed: Jan. 23, 2020

(65) Prior Publication Data

US 2021/0231303 A1 Jul. 29, 2021

(51) Int. Cl.
*F21V 35/00* (2006.01)
*A47G 19/22* (2006.01)

(52) U.S. Cl.
CPC ..... *F21V 35/00* (2013.01); *A47G 19/2227* (2013.01); *A47G 19/2272* (2013.01); *B65D 2543/00092* (2013.01); *B65D 2543/00296* (2013.01)

(58) Field of Classification Search
CPC ..... F21V 35/00; F21V 35/003; B65D 2543/00092; B65D 2543/00296; B65D 2543/00046; B65D 43/0212; B65D 2543/00537; B65D 2543/00351; A47G 19/2227; A47G 19/2272
USPC ..... 431/292; 220/713, 254.3, 254.7, 375, 220/832, 269.1, 801; 229/404, 906.1; 215/355
See application file for complete search history.

(56) References Cited

U.S. PATENT DOCUMENTS

| | | | | |
|---|---|---|---|---|
| 2,393,767 | A | 1/1946 | Gould | |
| 2,406,777 | A * | 9/1946 | Koretzky | F21V 35/00 431/126 |
| 2,997,199 | A | 8/1961 | Reachi | |
| 4,884,966 | A | 12/1989 | Wexler | |
| 5,975,889 | A | 11/1999 | Culpepper | |
| 8,052,003 | B2 * | 11/2011 | Burns | B65D 51/18 220/717 |
| D681,462 | S | 5/2013 | Taylor | |
| 9,113,733 | B2 * | 8/2015 | Wu | B65D 43/0218 |
| D738,546 | S | 9/2015 | Aubrey | |
| D820,480 | S | 6/2018 | Kaliroff | |
| 10,317,069 | B2 | 6/2019 | Johnson | |

(Continued)

FOREIGN PATENT DOCUMENTS

| | | |
|---|---|---|
| GB | 110822 | 11/1917 |
| GB | 153859 | 11/1920 |

OTHER PUBLICATIONS

"BarConic® Birthday Beer Candle Holders." Bar Supplies.com : The Supply Superstore for Bar Supplies, Wine Accessories, and Restaurant Supplies., Apr. 2016, barsupplies.com/birthday-beer-candle-holders.html.

(Continued)

*Primary Examiner* — Christopher R Demeree
(74) *Attorney, Agent, or Firm* — Leason Ellis LLP

(57) ABSTRACT

A lid for a container is provided and includes a lid body that is configured to be securely coupled to the container. The lid body has a base portion and a flange portion that engages the container. The base portion has an integral upstanding candle holder that extends upwardly from the base portion and includes a hollow center section configured to receive and hold a candle in an upright position.

5 Claims, 5 Drawing Sheets

(56) References Cited

U.S. PATENT DOCUMENTS

| | | | | |
|---|---|---|---|---|
| 2014/0138379 | A1* | 5/2014 | Hill | B65D 51/24 215/229 |
| 2017/0027349 | A1 | 2/2017 | Lowder | |
| 2018/0215507 | A1* | 8/2018 | Ingram | B65D 25/205 |
| 2021/0179327 | A1* | 6/2021 | Bernstein | B65D 51/245 |

OTHER PUBLICATIONS

O'Carroll, Eoin, "Starbucks to distribute billions of little plastic sticks", The Christian Science Monitor, Apr. 15, 2008.

* cited by examiner

CONTAINER LID WITH INTEGRAL CANDLE HOLDER

TECHNICAL FIELD

The present invention relates to a container lid, such as a beverage lid, and more particularly, relates to a container lid with an integral candle holder for a celebratory event, such as a birthday.

BACKGROUND

Celebratory food and traditions have been around for thousands of years and the Greeks would make round cakes to honor Artemis, the goddess of the moon. It is generally believed that the tradition of placing a candle on a celebratory cake started in Germany. More particularly, in 18th century Germany, the history of candles on cakes can be traced back to Kinderfest, a birthday celebration for children. This tradition also makes use of candles and cakes. The candle was supposedly placed on the cake to represent "the light of life". Today, most western cultures celebrate birthdays with cake, lit candles and a birthday song.

However, many people do not like to eat cake; however, they enjoy the candle celebration and act of making a birthday wish and blowing out the candle and therefore, there is a need for an alternative to the long-standing tradition of placing one or more candles on a cake. The present disclosure provides a solution.

SUMMARY

In accordance with one embodiment, a lid for a container that includes a lid body that is configured to be securely coupled to the container. The lid body has a base portion and a flange portion that engages the container. The base portion has an integral upstanding candle holder that extends upwardly from the base portion and includes a hollow center section configured to receive and hold a candle in an upright position.

In another aspect of the present disclosure, a celebratory kit for use with a container includes a lid for a container. The lid includes a lid body that is configured to be securely coupled to the container. The lid body has a base portion and a flange portion that engages the container. The base portion has an upstanding candle holder that extends upwardly from the base portion and includes a hollow center section. The kit also includes a candle that is received and held within the candle holder in an upright position.

The lid of the present disclosure thus provides an alternative way to celebrate a special event, like a birthday, for people who prefer not to celebrate with a traditional cake and candle. Instead, the celebratory event can be marked by presentation on a lid that is placed on a beverage container. Thus, retail establishments, such as coffee shops, can stock this product for patrons celebrating an event.

BRIEF DESCRIPTION OF THE DRAWING FIGURES

DETAILED DESCRIPTION OF CERTAIN EMBODIMENTS

Figure 1:
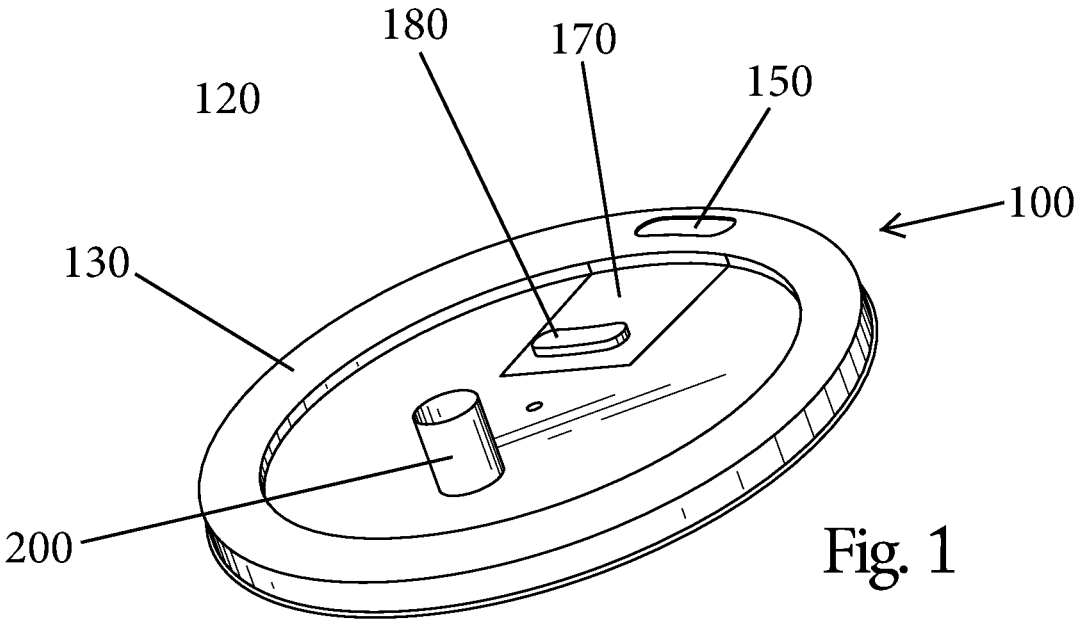
FIG. 1A is a top perspective view of a container lid with integral candle holder according to a first embodiment.
Figure 5A:
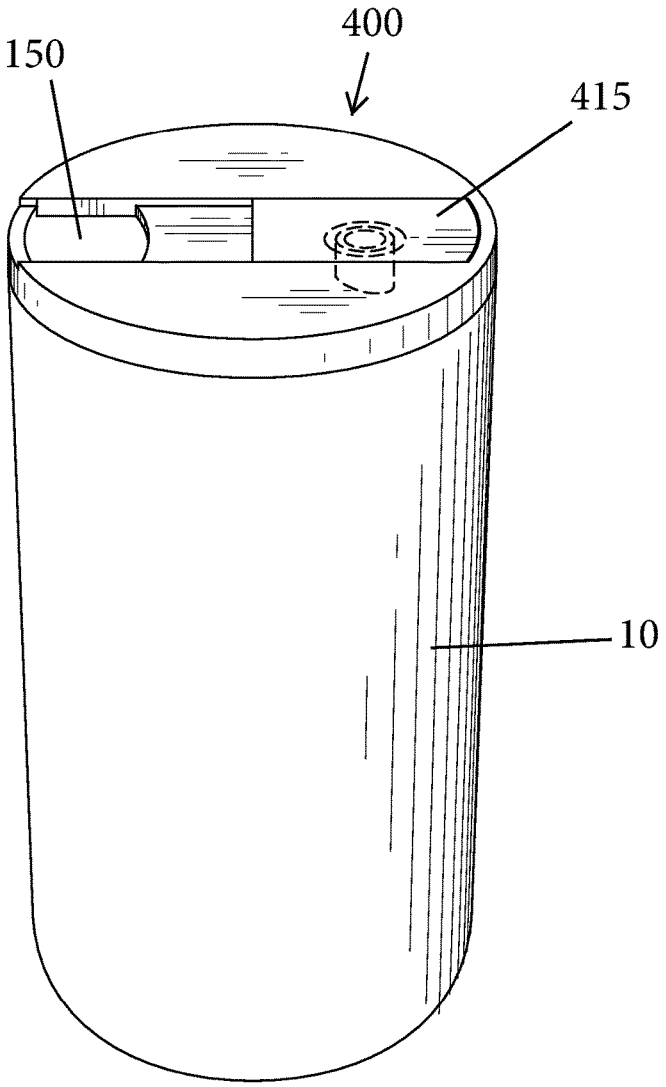
FIG. 5A is a perspective view of a container lid with integral candle holder according to a sixth embodiment in a first state.

FIG. 1 illustrate a container lid 100 and more particularly, illustrate a beverage lid 100 that is configured for placement on a top of a container (cup) 10 (FIG. 5A). One of the more common types of container lids 100 is a coffee cup lid that is placed on a disposable coffee cup 10. The intent of any lid, including lid 100, is to reduce or prevent spills.

The lid 100 includes a top wall 120 for covering the container 10 and a rim 130 (circular sealing flange) for securing the lid 100 to the cup 10 and providing a seal around a lip of the cup 10. The rim 130 includes a continuous perimeter which, when pressed over the lip of the cup 10 seals the cup 10 against spillage of liquid therefrom.

Figure 4A:
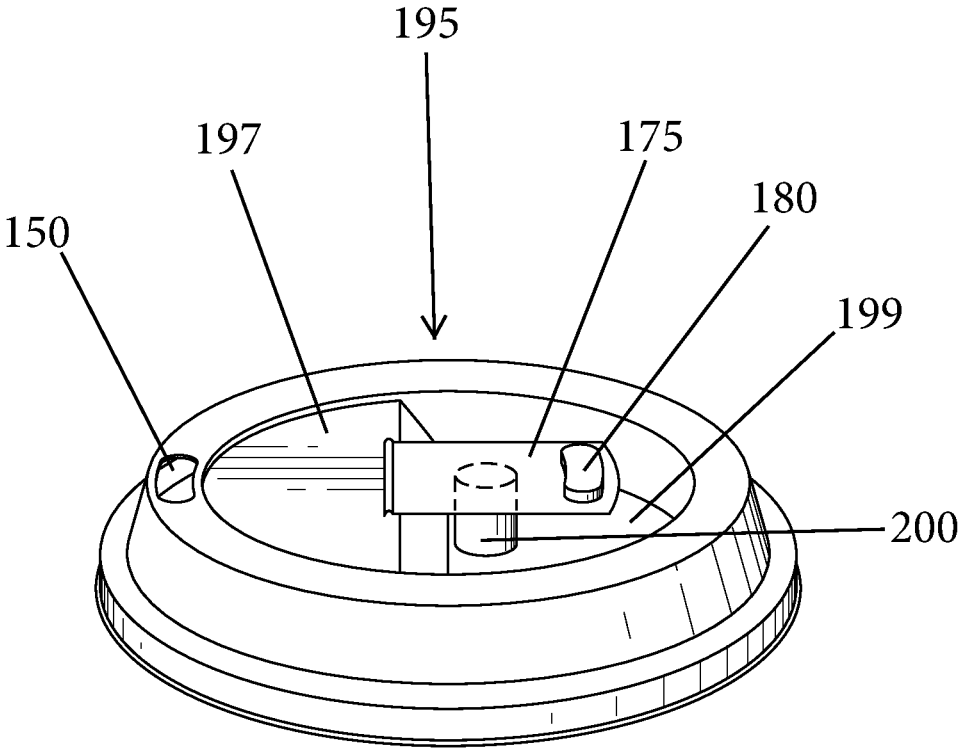
FIG. 4A is a top perspective view of a container lid with integral candle holder according to a fourth embodiment in a first state.

Many types of lids, including the illustrated lid 100, are constructed such that the top wall 120 is elevated (FIG. 4A) or recessed (as shown) relative to the rim 130. As shown in FIG. 4A, when the top wall 120 is elevated, a second flange 140 or shoulder being defined between the rim 130 and the top wall 120. A spout or drinking opening 150 can be provided in the lid to enable drinking without removal of the lid 100. As shown in FIG. 4A, the spout or drinking opening 150 can be raised above the top wall 120 of the lid 100. In FIG. 1, the drinking opening 150 is formed along the outer flange defining the rim 130.

As is known and shown in the figures, some lids for beverage containers include a pull-back part 170 (flap) (movable or hinged plug) that is designed to temporarily plug the drinking opening 150 formed in the lid and therefore temporarily seals the lid and prevent an accidental spill, the flap 170 is pivoted upward to cause a plug member 180 to be inserted into the drinking opening 150. This pull-back part (flap 170) is hingedly connected to the lid body and is designed to move between a first position in which the pull-back part is in an open position to expose the drinking opening 150 and permit drinking and a closed position to plug the drinking opening 150. Typically, one end of the flap is hingedly connected to the lid body and the other end includes the plug member 180. The plug member 180 is a protrusion that protrudes outwardly from a first face of the pull-back part 170.

In accordance with the present disclosure, the lid 100 is constructed to include one or more integral candle holders 200 for receiving one or more celebratory candles 300 (FIG.

3B). More particularly, the candle holder 200 can be in the form of a well or hollow protrusion that extends upwardly from the top wall 120 as shown in FIG. 1. Since most candles 300 have circular shapes, the one or more candle holders 200 have complementary circular shapes to accommodate and hold the one or more candles 300. The candle holder 200 is thus spaced from the drinking opening 150 when present as part of the lid 100.

As mentioned herein, while the holder 200 is described as a candle holder, that is merely one embodiment and application of the holder 200. Other applications are equally possible, including holding other celebratory objects, such as a sparkler or any other upstanding, vertical object that can be inserted and held and contained within the holder. For example, a small celebratory flag can be held by the holder or even a small electronic message board that includes a post that is held within the holder.

The handle holder 200 is preferably integrally formed with the rest of the lid 100 as by a molding process (e.g., injection molding process).

The candle 300 is inserted into the candle holder 200 and held there by a friction fit. The height of the integral candle holder 200 is thus selected so that the candle 300 is sufficiently supported within the candle holder 200 in its upright in-use position. In other words, the candle holder 200 surrounds a bottom portion of the candle 300 for support thereof. A friction fit allows for easy insertion and removal of the candle 300.

Other types of mechanical attachment techniques can be used to couple the candle 300 to the candle holder 200 beyond a friction fit. For example, a snap fit can be formed between the candle 300 and the candle holder 200.

Figure 2:
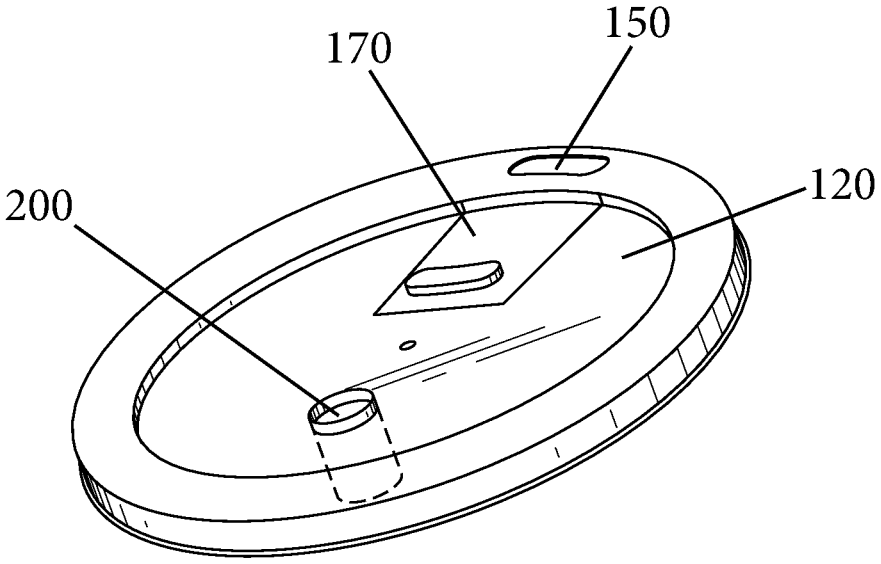
FIG. 2 is a top perspective view of a container lid with integral candle holder according to a second embodiment.

FIG. 2 shows an alternative construction in which the candle holder 200 does not protrude upwardly from the top wall 120 but instead is recessed relative to the top wall 120. In other words, as shown, the candle holder 200 extends downwardly from the top wall 120 and thus, represents a recessed well or the like to receive the candle. The candle holder 200 thus extends down toward and into the hollow interior of the container (cup) to which the lid is attached.

Figure 3A:
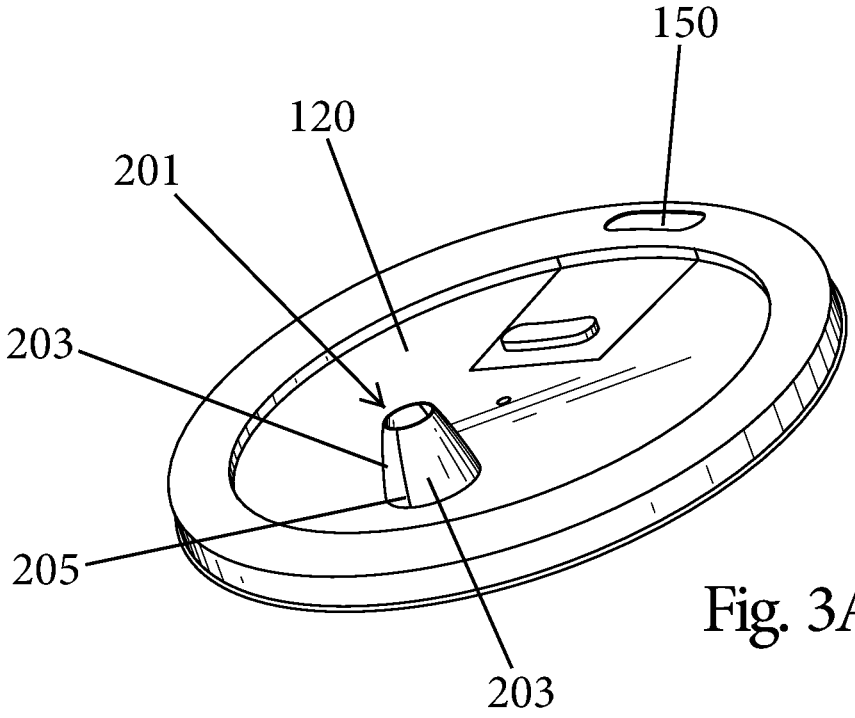
FIG. 3A is a top perspective view of a container lid with integral candle holder according to a third embodiment in a first state.
Figure 3B:
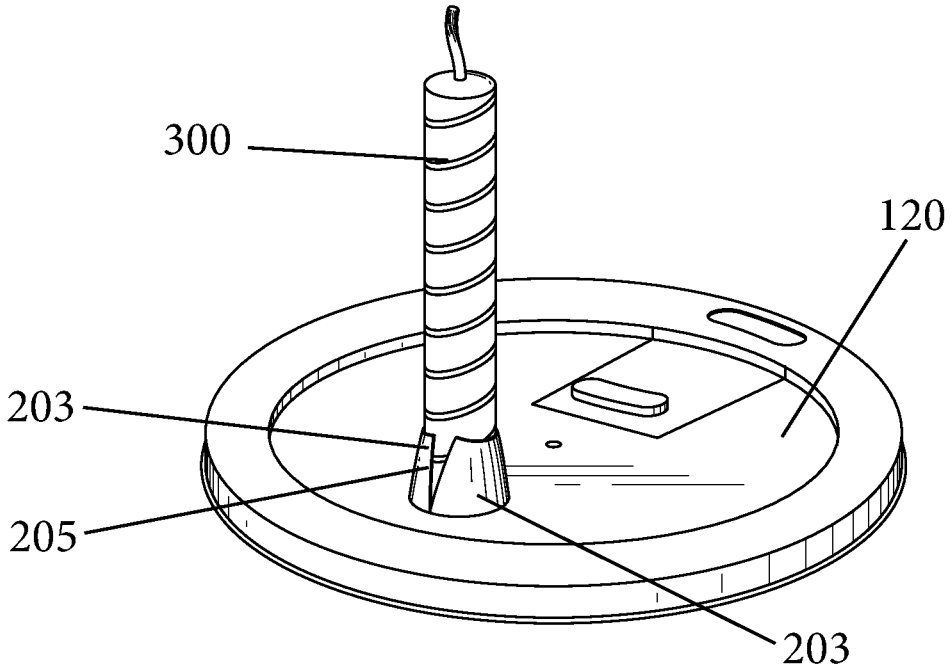
FIG. 3B is a top perspective view of a container lid with integral candle holder according to the third embodiment in a second state.

As shown in FIGS. 3A-3B, it will also be appreciated that the candle holder 200 is not limited to being a completely continuous circular shaped hollow structure but instead, a candle holder 201 according to an alternative embodiment can be formed of several discontinuous arcuate shaped wall sections 203. For example, two arcuate shaped walls 203 can be formed with the ends thereof separated from one another by a slit 205 (each arcuate shaped wall 203 is thus less than 180 degrees). The discontinuous nature of the two arcuate shaped upstanding walls 203 allows for the flexing of the walls 203 to accommodate the candle 300. For example, the insertion of the candle 300 into the candle holder 200 can cause an outward flexing of the walls 203 and establishes a secure friction fit between the candle 300 and the candle holder 200. The arcuate walls 203 are thus internally and inwardly biased such that insertion of the candle 300 into the space between the walls 203 applies an outward force to the walls 203 resulting in outward flexing and accommodation of the candle 300 as shown in FIG. 3B.

It will also be appreciated that the inside of the candle holder 200, 201 can include surface texture to facilitate the gripping and holding of the candle 300. For example, the inside of the candle holder 200, 201 can include barbs or the like that engage the candle 300. These barbs are formed of the same material as the candle holder 200, 201 and are integrally formed therewith.

It will also be appreciated that when multiple candle holders 200 are present, the candle holders 200 can have different constructions, such as different shapes and sizes.

The candle 300 can be any number of different types of candles including but not limited to a burning candle, a battery powered electric candle, etc. The candle 300 can come in any number of different shapes and colors. For example, the candle 300 can be a traditional straight shaped candle or it can have a curved, curly-cue shape or any other shape.

The lid 100 can be formed of any number of suitable materials including plastic materials suitable for containing a material in the cup 10.

Figure 4B:
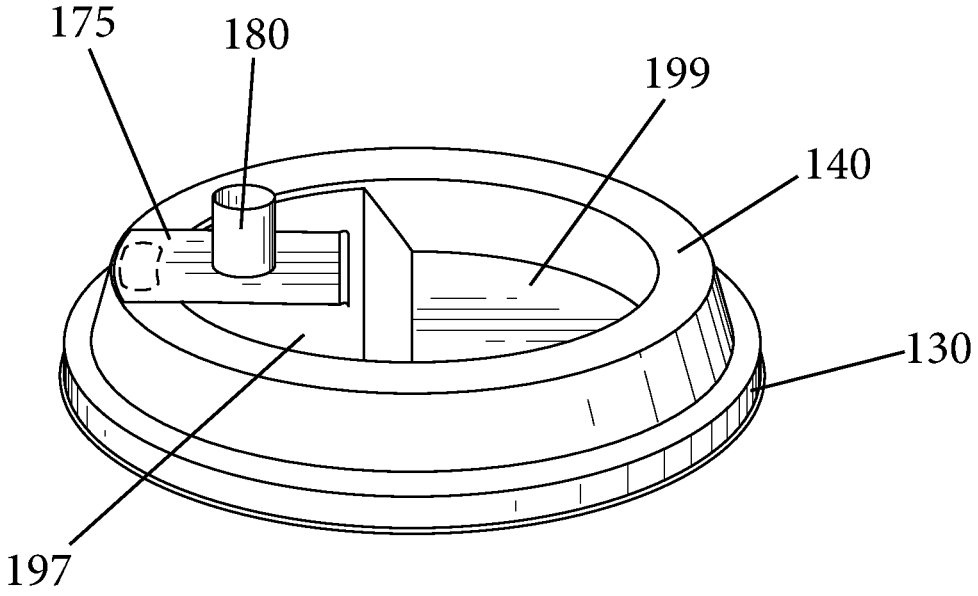
FIG. 4B is a top perspective view of a container lid with integral candle holder according to the fourth embodiment in a second state.

In accordance with the present disclosure, an alternative lid 195 according to the embodiment shown in FIGS. 4A and 4B includes a pull-back part (flap) 175 incorporates the candle holder 200. In particular, a second face, opposite the first face, of the pull-back part 175 can include the candle holder 200 that extends upwardly therefrom when the pull-back part 175 is in the closed position as shown in FIG. 4B. The lid 195 has a raised top wall 197 and the drinking opening 150 is formed in the raised second flange 140.

The lid 195 also has a recessed portion 199 that accommodates the candle holder 200 when the lid 195 is in the open position (FIG. 4A). The candle holder 200 is thus formed along one face of the flap 175, while the plug member 180 is on the opposite face.

In this construction (FIGS. 4A and 4B), the candle is held in the upright position only when the pull-back part 175 is in the closed position (FIG. 4B) and thus, the drinking opening 150 is plugged and the user is not drinking from the cup.

Figure 5B:
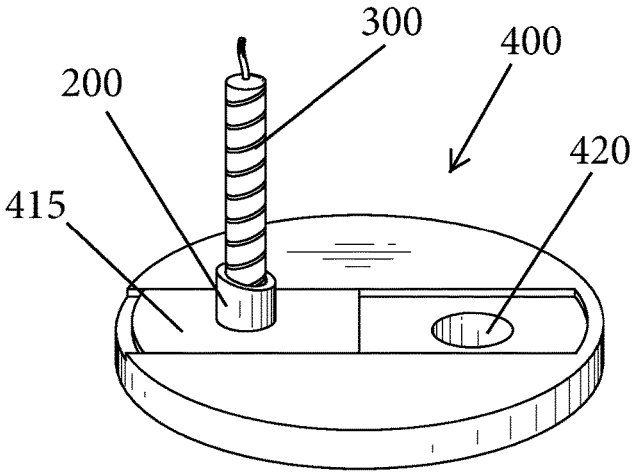
FIG. 5B is a top perspective view of the container lid with integral candle holder according to the sixth embodiment in a second state.

In FIGS. 5A and 5B, a different type of lid 400 is shown for attaching to container 10 that can be an insulated cold/hot beverage container, or juicer, etc. The lid 400 has a top wall 410 with drinking opening 150 formed therein and also a candle receiving opening 420 is formed therein. A movable flap (hinged flap) 415 is provided and the candle holder 200 is integral thereto. The candle receiving opening 420 is configured to receive the candle holder 200 when the flap 415 is in the open position. Thus, the candle can be inserted into the candle holder 200 only when the flap 415 is in the closed position of FIG. 5B and the drinking opening 150 is closed. The user thus pivots the flap 415 between the open and closed position.

The present disclosure thus provides a product that can be easily used with an everyday item and provides an alternative to the traditional placement of a candle in cake to celebrate and make a wish.

Figure 6A:
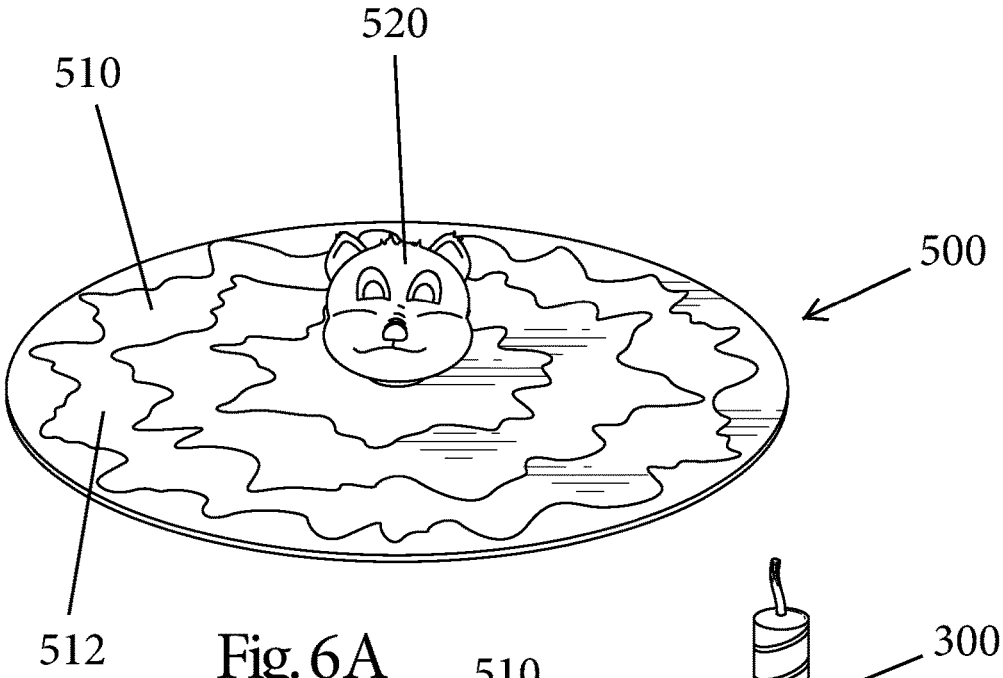
FIG. 6A is a top perspective view of a decorative cover with integral candle holder according to a seventh embodiment.
Figure 6B:
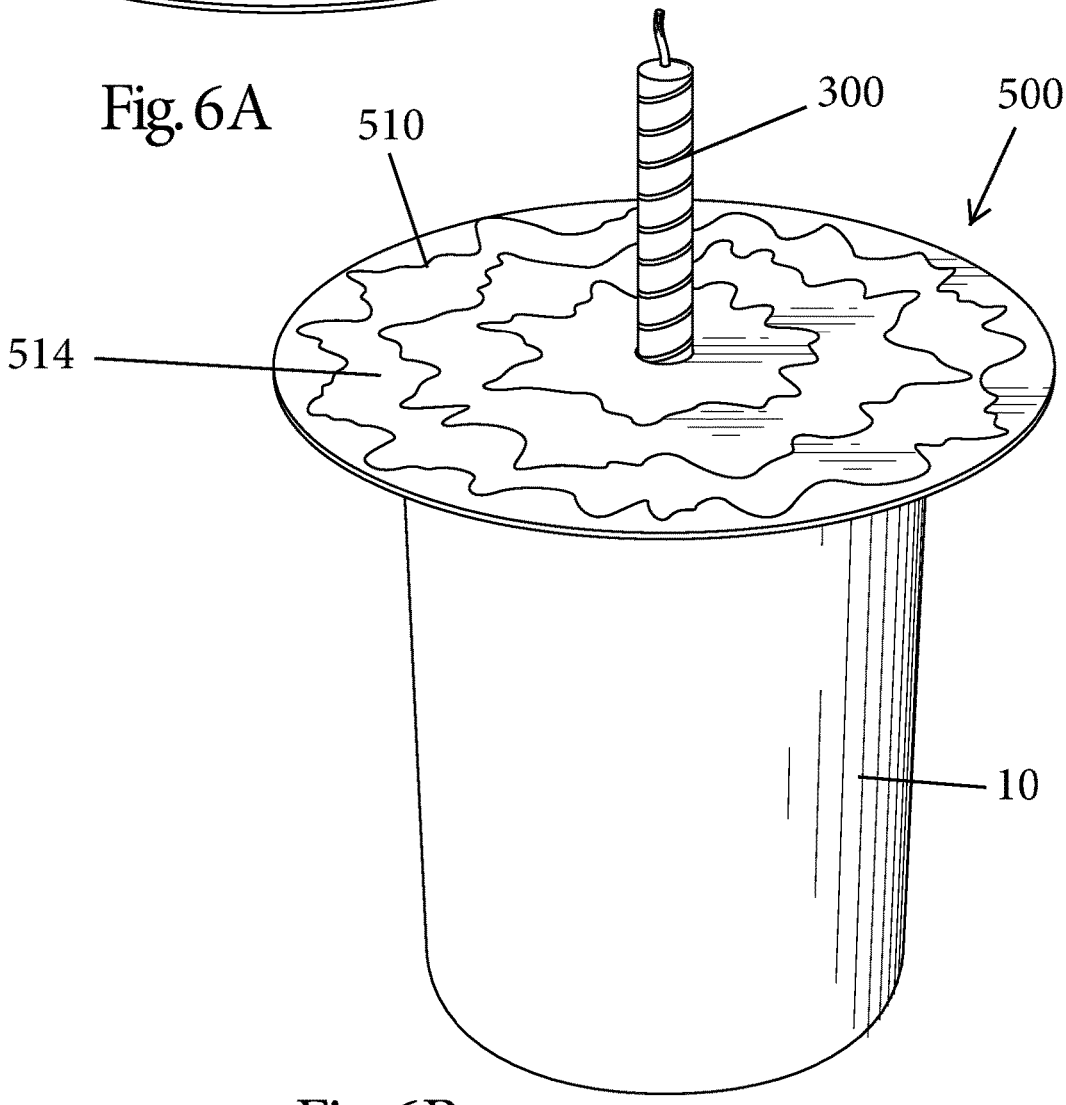
FIG. 6B is a bottom and side perspective view of the decorative cover on top of a container and showing a candle inserted into the integral candle holder.

FIGS. 6A and 6B illustrate yet another embodiment of the present disclosure. The container 10 is illustrated along with a cover 500 that is meant to cover the open end of the container 10. The cover 500 is a decorative element that may or may not seal with the open end of the container 10. The cover 500 can thus be simply placed on the open end of the container 10. As illustrated, the cover 500 has a cover body 510 that can be formed as one or more layers. The cover 500 further includes a decorative piece 520, such as the illustrated animal, that is located in the center of the cover body 510. The decorative piece 520 can include a post or stem that extends through a hole formed in and through the cover body 510. In other words, the decorative piece 520 can be located along the top face 512 (one side) of the cover body 510 and the hollow stem can be open and accessible along the opposite bottom face 514 of the cover body 510. The hollow stem thus can act as a holder, such as a candle holder, for receiving and holding the candle 300 as shown in FIG. 6B.

Thus, during normal covering, the decorative piece 520 faces upward when the cover 500 is placed on the container 10 and conversely, when the user wants to celebrate, the cover 500 is flipped over and the hollow stem is accessible and the candle 300 can be placed into the hollow stem and held therein.

As with the other embodiments, more than one candle 300 or other decorative element can be displayed on the cover body 510. In addition, the bottom face of the cover body 510 can include one or more protrusions that extend outwardly from the bottom face and are hollow to receive the candle 300 or decorative element.

It will also be understood and appreciated that the present disclosure is not limited to candles (electric or natural (wax, soy, etc.) format) but also other decorative and festive elements can be displayed with the integral holder described herein but not limited to a candle holder. For example, a sparkler or the like or any vertical festive or decorative extension can be placed and held within the holder to mark the celebration. In addition, as mentioned previously, while one candle is illustrated in the figures, it will be appreciated that more than one candle, sparkler, vertical extension, etc., can be held using multiple holders.

In addition, the present holder can be implemented in many different types of lids including lids that do not have drinking openings.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A lid for a container comprising:

a lid body that is configured to be securely coupled to the container, the lid body having a base portion and a flange portion that engages the container, the base portion have a raised top wall and an adjacent recessed portion that is recessed relative to the raised top portion, the lid having a pull-back flap that is attached to the raised top portion and includes an integral upstanding candle holder that extends upwardly from a top surface of the pull-back flap and includes a hollow center section configured to receive and hold a candle in an upright position, wherein the candle holder is formed at a position of the top surface and has a height that allow the handle holder to be received within the recessed portion when the pull-back flap is in an open position with the top surface facing the recessed portion, wherein a drinking opening is formed in the flange portion, the flange portion being elevated relative to the raised top portion of the base portion.

2. The lid of claim 1, wherein the lid body comprises an integral plastic body.

3. The lid of claim 1, wherein the upstanding candle holder comprises a cylindrical shaped hollow structure defined by a continuous outer wall.

4. The lid of claim 1, wherein the raised top portion comprises a planar surface from which the candle holder extends outwardly and upwardly, wherein a sloped wall is formed between the raised top portion and the recessed portion.

5. A lid for a container comprising:

a lid body that is configured to be securely coupled to the container, the lid body having a base portion and a flange portion that engages the container, the base portion have a raised top wall and an adjacent recessed portion that is recessed relative to the raised top portion, the lid having a pull-back flap that is attached to the raised top portion and includes an integral upstanding candle holder that extends upwardly from a top surface of the pull-back flap and includes a hollow center section configured to receive and hold a candle in an upright position, wherein the candle holder is formed at a position of the top surface and has a height that allow the handle holder to be received within the recessed portion when the pull-back flap is in an open position with the top surface facing the recessed portion, wherein a bottom surface of the pull-back flap that is opposite the top surface includes a plug member that protrudes outwardly from the bottom surface, the plug member being configured to be received within a drinking opening formed in the flange portion when the pull-back flap is in a closed position and the candle holder stands upright.

* * * * *